United States Patent [19]

Loomie

[11] Patent Number: 5,072,527

[45] Date of Patent: Dec. 17, 1991

[54] METHOD AND APPARATUS FOR CONVEYING AND TENSIONING A LENGTH OF SHEET MATERIAL

[76] Inventor: Leo S. Loomie, 9 Hall Pl., Albany, N.Y. 12210

[21] Appl. No.: 534,112

[22] Filed: Jun. 6, 1990

[51] Int. Cl.[5] ..... F26B 13/00

[52] U.S. Cl. ..... 34/153; 34/118; 242/75.1

[58] Field of Search ..... 34/52, 153, 154, 155, 34/114, 116; 242/75-75.4, 75.43, 75.47; 226/195

[56] References Cited

U.S. PATENT DOCUMENTS

| | | | |
|---|---|---|---|
| 1,080,517 | 12/1913 | Miller . | |
| 2,219,701 | 10/1940 | Remington . | |
| 2,583,674 | 1/1952 | Tobler . | |
| 3,257,734 | 6/1966 | Boadway et al. | 34/18 |
| 3,299,484 | 1/1967 | Pernick . | |
| 3,370,359 | 2/1968 | Beachler | 34/18 |
| 4,477,983 | 10/1984 | Andersson et al. | 34/116 |
| 4,630,339 | 12/1986 | Morizzo | 26/70 |
| 4,686,778 | 8/1987 | Kotitschke et al. | 34/117 |
| 4,858,843 | 8/1989 | Glerso | 242/65 |
| 4,918,836 | 4/1990 | Wedel | 34/23 |

*Primary Examiner*—Henry A. Bennett
*Assistant Examiner*—Denise L. F. Gromada

[57] ABSTRACT

This invention relates in general to sheet material conveyor devices, and in particular to an apparatus to convey under controllable tension and under controllable speed sheet materials such as textile fabrics for the purpose of decoration. The apparatus comprises a feed means, a tensioning assembly, a drying assembly, a drive assembly, and a gearmotor with variable speed low RPM control.

1 Claim, 1 Drawing Sheet

METHOD AND APPARATUS FOR CONVEYING AND TENSIONING A LENGTH OF SHEET MATERIAL

BACKGROUND OF THE INVENTION

1. Field of the Invention

This invention relates in general to a method and apparatus for conveying sheetlike material, such as textile fabrics, and in particular to an apparatus for conveying and tensioning lengths of fabric for the purpose of hand dyeing and painting.

2. Description of Related and Prior Art

In the field of hand dyed fabrics, free flowing dyes are applied by hand, with brushes, primarily to cotton and silk, in various original patterns. Although the dyes may be thickened, in the preferred technique, a characteristic "watercolor" look is desirable. This requires special handling of the fabric. The material must be horizontal, so the flow of the dye on the surface is regular and controllable. If the fabric to be dyed is laid loosely on a worktable, the applied dye will run along the irregularities and folds created by the loose fabric. The solution is to keep a length of material under constant tension as dye is applied.

In art forms such as oil painting, pigments are applied to an impermeable surface such as primed canvas, and the back of the canvas remains dry. When dye is applied to a material, the liquid permeates the fabric, so if it touches any object when wet, the dye will transfer through the fabric to the object. This produces a noticeable defect called "mark off", which spoils the design. The solution is to suspend the fabric above the work surface while the fabric is moving, and to dry it continuously as it travels, so it is dry before it again touches any surface.

The current method for hand dyers who must hand dye bolts of material of typically fifty yards is to unwind a piece of the fabric of the length of a work table, typically from eight to twenty feet, and then pin it to a frame with push pins to hold it off the surface. The dyer paints the section, and must wait until the piece is dry to unpin it, fold the painted section, and laboriously repeat the process for the next length. In addition to the time lost waiting for the piece to dry, the length of fabric is unwieldy, and subject to mark off. Another problem that results is that the material slackens and subsequently drops after being wetted with the dye, so the center of the fabric touches the work table, causing "mark off". The push pins must then be re-positioned, which is inconvienent.

Another problem with push pins is that the heads of the pins extend above the surface of the fabric, hindering the free movement of the brush as it passes over them. If the brush touches a push pin, the dye can accumulate at the point where the brush touches the pin, and the excess dye must be blotted quickly by the dyer to avoid spoiling the design. Another problem is that dye tends to collect on the under surface of the push pins from the wet fabric, causing "mark off", which necessitates cleaning the pin after every piece dyed.

The present invention solves these problems by offering an apparatus which allows the hand dyer to continuously dye a bolt of material from end to end. The fabric, in bolt form on a cardboard tube, is slipped onto a free wheeling supply roll, threaded through an adjustable tension apparatus, past an idler roller which turns the fabric to the horizontal position, past the dyeing area to a drying apparatus, an then onto a cardboard tube fitted over the drive roller, which is powered by a conveyor drive motor controlled by an electronic speed control. The drive roller is fitted with a hinged, sharpened, serrated, drive knife, which is held in contact with the inside of the removable cardboard tube by a leaf spring. The drive roller sits with one end removably seated in a notched bearing, while the opposite end is fitted with a universal joint, so the roller swivels off the notched bearing and the tube with the fabric is easily removed. If subsequent operations such as adding resists or dyeing areas with additional color are necessary, the fabric is slipped off the drive roll, replaced on the supply roll, and the additional processes are easily accomplished. This method and apparatus has been in use in my workshop since February, 1990, and has improved the production of hand dyed material in my workshop by a factor of five over the previous method of pinning short lengths of material to a frame off the work surface.

PRIOR ART

A search of prior art revealed no machine made for the purpose of continuously hand dyeing bolts of sheet material. The closest machines found to be of similar structure are textile inspection machines and drying machines, listed below:

Glerso et al. U.S. Pat. No. 4,858,843, Morizzo U.S. Pat. No. 4,630,339, Haines U.S. Pat. No. 4,422.223, Pernick U.S. Pat. No. 3,299,484, Tobler U.S. Pat. No. 2,583.674, Miller U.S. Pat. No. 1,080,517.

None of the apparatuses as described in the patents listed are intended for dyeing material, and none would work for that function. None position the fabric horizontally, which is necessary for hand dyeing, and all use a table of some sort beneath the fabric which in the present use would cause unwanted "mark off". In addition these machines are all designed to run at a higher RPM than the present invention, and so would be useless for the purpose of hand dyeing. None call for the use of an electronic speed control which allows for precise adjustment of the desired speed at extremely low RPM. None require the drying apparatus called for in the present invention.

U.S. Pat. No. 3,257,734 to Boadway, et al, and U.S. Pat. No. 3,370,359 to Beachler are also known. Both of these devices are unusable for the purposes of hand dyeing for the reasons set forth below. The paper drying devices of Beachler and Boadway hold a web in intimate contact with heated drying cylinders, fourdrinier wire conveyors, felts and pressure rolls. All of the devices mentioned above would cause unwanted markoff in wet hand dyed fabrics. The high velocity air jets cited would serve no purpose in a textile web as adhesion to guide rollers and attempts to smooth out discrepancies in web speed are not problems encountered in hand dyeing textile fabrics. Also the difference in driven cylinder speeds, although desireable in drying a paper web, would irreversibly damage a textile web.

The invention differs more substantially from prior art industrial textile machinery in that it is designed specifically for the individual craftsman working in a medium which requires unique "one off" designs on small runs of fabric. Unlike heavily built and costly industrial machines which may superficially appear to have a similar function, it is intended to be run at extremely slow speeds, to be built compactly of lightweight materials and to be economically constructed and shipped. The apparatus may also be easily adapted to apply silk screen designs. A preliminary survey of craftsmen in the field of hand decorated fabrics conducted in May, 1990, showed substantial and enthusiastic interest in the invention.

SUMMARY OF THE INVENTION

The object of the present invention is to provide an apparatus and method for suspending and tensioning long lengths of fabric in continuous and controllable motion in a horizontal plane for the purpose of decoration.

It is also an object of the present invention to provide an apparatus which is inexpensive to manufacture and of simple construction.

Another object is to provide such an apparatus built as lightweight as possible and that is easily assembled for use and disassembled for shipment.

A further object is to provide such an apparatus which is safe to use, is easily cleaned, and in which the parts are both durable and easily replaced.

DETAILED DESCRIPTION

Figure 1:
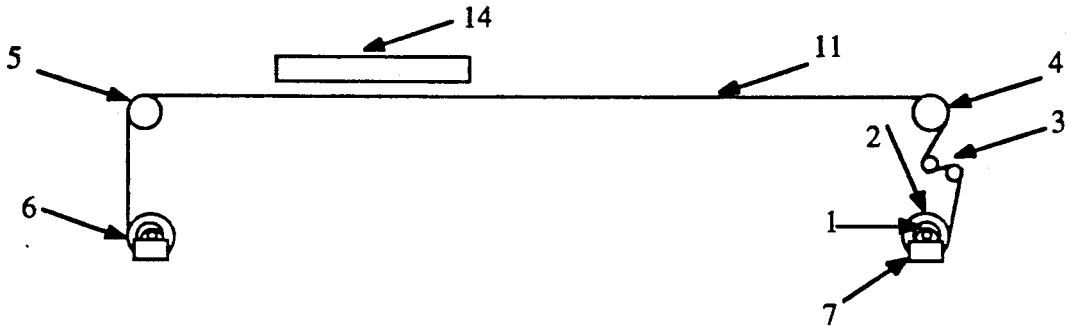
FIG. 1 is a side view of the apparatus, showing the feed roller, tension assembly comprising friction bars, idler rollers, drive roller, and bearing notches. The path of the fabric is indicated. The direction of the fabric is indicated by arrows.

Refer now to FIG. 1 which is a section view of the apparatus, which comprises a supply roller, 1, on which a bolt of material to be dyed, 2, is slipped on endwise, and allowed to rotate freely, on a pair of notched bearings, 7. The fabric, 11, is then threaded through a tension apparatus, 3, typically comprising a plurality of fixed round bars, over which the fabric passes, with increasing tension, but which may alternately comprise any commonly used tensioning apparatus. The fabric, 11, then passes over an idler roller, 4, which is allowed to turn freely, the fabric, 11, then moving in a horizontal plane, to a point, 15, where dye is applied, the fabric, 11, then passing under a typical drying apparatus, 14, which may comprise, according to the type of energy available or most economical, infrared heat, electric resistance heat, natural or propane gas heat, forced air, or any combination of the foregoing, or any other means of drying commonly used. The fabric, 11, thence passes over a second idler roller allowed to turn freely and finally to the drive roller, 6, supported at one end by the notch bearing, 7. It will be apparent that the fabric is intended to be supported in a horizontal position without touching any part of the apparatus until it drys in passing from the idler roller, 4, to the idler roller, 5.

Figure 2:
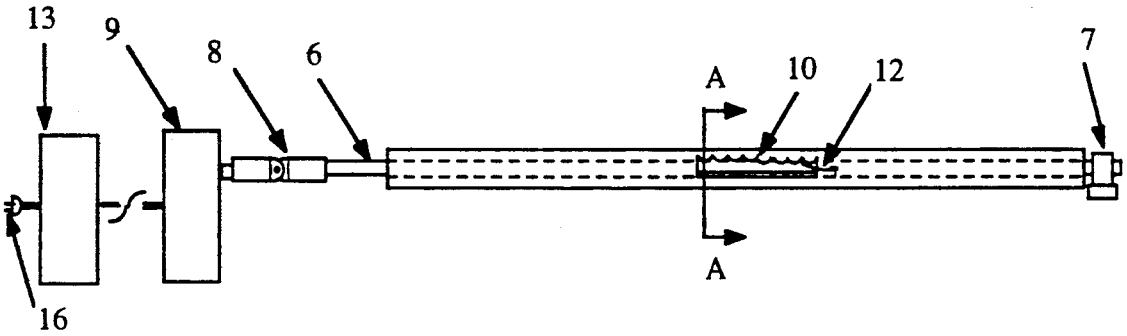
FIG. 2 is an elevation view of the drive roll gearmotor and speed controller and power switch assembly, showing the placement of the universal joint, notch bearing, drive knife and leaf spring.

FIG. 2 is a side view of the drive roller assembly, showing the drive roller, 6, supported on one end by the notch bearing, 7, and attached at the opposite end to a universal joint, 8, which in turn is attached to the gearmotor, 9, wired to the speed controller and power switch, 13, in turn wired to a plug, 16, to be plugged into a power supply. The drive knife, 10, and the leaf spring, 12, are shown. The upper edge of the drive knife is sharpened and serrated to positively engage the inside surface of the tube, 17.

Figure 3:
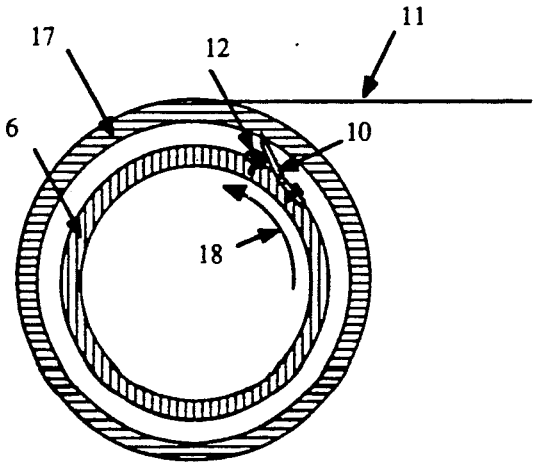
FIG. 3 is an enlarged section of the drive assembly as taken at A—A, in FIG. 2, showing the drive roller, drive knife, leaf spring, fabric, and cardboard tube.

FIG. 3 is a section detail of the drive roller assembly. The drive knife, 10, and the leaf spring, 12, are attached to the drive roller, 6, so that they fit slidably in the cardboard tube, 17. When the cardboard tube, 17, is slid onto the drive roller, 6, by lifting the drive roller off the bearing notch, 7, such movement allowed by the universal joint, 8, the drive knife, 10, is manually depressed against the drive roller, 6, overcoming the pressure of the leaf spring, 12, to allow the cardboard tube, 17, to pass over the drive assembly. The leaf spring, 12, is positioned between the drive knife, 10, and the drive roller, 6. Once the tube, 17, is slipped over the drive assembly, manual pressure being released, the drive knife, 12, is held against the tube, 17, tensionally by the leaf spring, 12.

It will be clearly seen that the drive roller, drive knife and leaf spring act in concert as means to drive the cardboard tube, 17, and the fabric, 11, which is wound upon it. When the gearmotor, 9, is activated by the speed controller and power switch, 13, the drive knife, 10, engages the tube, 17, pulling the fabric, 11, which is wound upon the tube, 17, through the apparatus from the feed roller, 2. The speed controller and power switch, 13, adjust the speed of the drive roller from approximately 0–30 RPM. This very low speed range allows the dyer sufficient time to continuously paint the desired pattern, and to adjust at any time the speed of the fabric to the complexity of the required design.

The foregoing description of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus for suspending and conveying, with adjustable tension and adjustable speed, a length of textile fabric above a work surface comprising:

a feed means comprising a free turning feed roller removably seated in notch bearings at either end attached to a tensioning means comprising a plurality of friction bars attached to a drying means attached to a drive assembly comprising a drive roller upon which said length of textile fabric is wound, conveyor drive motor and controls;

said drive roller having two ends, the first end seated removably in a notch bearing, the second end attached to a universal joint which allows said drive roller to pivot freely about said universal joint, said drive roller comprising a drive knife attached approximately centrally, and comprising a tube of sufficiently greater diameter than said drive roller to allow said tube to be slideably removably attached to said drive roller, said drive knife comprising a hinge pin and an upper and lower extending planar member pivotably attached thereto, the lower planar member attached to said drive roller, the upper planar member having the upper edge sharpened and serrated, and said drive knife further comprising a leaf spring which is comprised of a curved length of spring steel in the form of a shallow arc, the leaf spring having an upper and lower end, said leaf spring positioned below said upper planar member of said drive knife so that the lower end of said leaf spring is attached to said drive roller, and the upper end of said leaf spring is held in contact with said upper planar member of said drive knife so that said upper planar member is in pressurable contact with said tube, said conveyor drive motor comprising a gearmotor attached to said drive motor controls, said drive motor controls comprising an electronic speed controller attached to a power switch and means to connect to a power supply.

* * * * *